US008153578B2

(12) United States Patent
Seipler et al.

(10) Patent No.: US 8,153,578 B2
(45) Date of Patent: Apr. 10, 2012

(54) SOAP RECYCLING SYSTEM AND METHOD

(75) Inventors: Shawn Seipler, Orlando, FL (US); Paul Till, Orlando, FL (US); Steve Delisle, Ocoee, FL (US); Edward C. Foster, Orlando, FL (US); Enrique Galarza, Orlando, FL (US); Steve Cooper, Orlando, FL (US); Noel Alamo, Kissimmee, FL (US)

(73) Assignee: Clean The World Foundation, Inc., Orlando, FL (US)

( * ) Notice: Subject to any disclaimer, the term of this patent is extended or adjusted under 35 U.S.C. 154(b) by 267 days.

(21) Appl. No.: 12/614,858

(22) Filed: Nov. 9, 2009

(65) Prior Publication Data

US 2011/0112001 A1 May 12, 2011

(51) Int. Cl.
*C11D 13/00* (2006.01)

(52) U.S. Cl. ..... 510/442; 510/456; 510/457; 510/141

(58) Field of Classification Search ..... None
See application file for complete search history.

(56) References Cited

U.S. PATENT DOCUMENTS 2,057,192 A 10/1936 Hutton
2,620,511 A * 12/1952 Marshall et al. ..... 264/349
4,168,550 A 9/1979 Lindauer
7,459,418 B1 12/2008 Ozment
2007/0241306 A1 10/2007 Wehner et al.

OTHER PUBLICATIONS

International Search Report for co-pending PCT Application No. PCT/US10/55973 dated Mar. 1, 2011, 5 pages.
Anklin et al.; "Sustainability—Putting a Face to the Name"; Hospitality Net Article; Jun. 19, 2009.
Baysac et al.; "Prevention and Control of Diarrheal Diseases"; IH887; Fall 1999.
Curtis et al.; "Effect of washing hands with soap on diarrhoea risk in the community: a systematic review"; The Lancet Infectious Diseases; vol. 3; May 2003; pp. 275-281.
Deloitte; "Americans Warm Up to Summer Travel in 2009"; New York, New York; May 12, 2009.
Luby et al.; "Effect of Intensive Handwashing Promotion on Childhood Diarrhea in High-Risk Communities in Pakistan"; The Journal of the American Medical Association; vol. 291, No. 21; Jun. 2, 2004.

* cited by examiner

*Primary Examiner* — Necholus Ogden, Jr.
(74) *Attorney, Agent, or Firm* — Patton Boggs LLP

(57) ABSTRACT

In one embodiment, a method for recycling soap includes scraping the surface of a soap bar using a bladed implement; soaking the soap bar in a cleansing solution including dimethyl benzylammonium chlorides monohydrate; placing the soap bar on a rack in a Rational Clima Plus Combi unit; placing a pan under the rack; steaming the soap bar using the Rational Clima Plus Combi unit for five minutes at 212° F.; cooling the soap bar in a refrigerator unit at 38° F. for at least seven minutes; and packaging the soap for reuse.

10 Claims, 4 Drawing Sheets

SOAP RECYCLING SYSTEM AND METHOD

BACKGROUND

Recycling and reusing is an important aspect for society and business. Soap is a material which traditionally has not been recycled. The hotel industry is one place that results in a large excess of partially used soap, resulting in waste and environmental issues.

The waste resulting from hotels is an issue to consumers and managers/owners alike. "Consumers are showing that environmental issues remain important to them, despite today's economic challenges. Thirty-two percent of those surveyed agreed that they expect the hotels they stay at to be environmentally friendly, and 29 percent said they would like to know more from hotels about their green efforts. Thirty-seven percent of consumers said they are more aware of the environment than they were a year ago." (April 2009 Survey by Deloitte)

"... [A] recent study by the Center for Hospitality Research at Cornell University stated that the economy and environment are the second most important issues of concern to managers in the lodging industry. Sustainability is an issue that every hotel company must inevitably deal with. The sooner they address it, the better they will be equipped for the future." ("Sustainability—Putting a Face to the Name" by Christian Anklin and Pierre Ricord)

The Sheraton Rittenhouse Square Hotel illustrates that customers do not have to sacrifice quality for sustainability. The extra costs involved in being environmentally responsible have been made up in increased occupancy rates. The Green Hotel Initiative may be well on its way to showing the hotel industry that there is room to be green.

Furthermore, there is a grave need in the world for usable soap. More than five million children die annually due to Acute Respiratory Illness and Diarrheal Illness. This is the leading cause of death among children worldwide. Eighty-five percent of diarrheal deaths occur during the first year of life, and approximately 4.6 million children under the age of five in developing countries die from diarrheal diseases each year. (IH 887, Baysac, Beilstein, 1999)

Studies on thousands of people show simple hand washing can reduce effects by 40%-65%. "Children younger than 15 years living in households that received handwashing promotion and plain soap had a 53% lower incidence of diarrhea compared with children living in control neighborhoods." (JAMA, Luby, Agboatwalla, Painter, Altaf, Billhimer, Hoekstra, 2004)

"On current evidence, washing hands with soap can reduce the risk of diarrheal diseases by 42-47% and interventions to promote handwashing might save a million lives." (The Lancet Infectious Diseases, Curtis, Cairncross, 2003)

SUMMARY OF THE INVENTION

In one embodiment, a method for recycling soap includes scraping the surface of a soap bar; soaking the soap bar in a cleansing solution; steaming the soap bar using a steaming unit; and cooling the soap bar. In one alternative, the scraping is performed with a bladed implement. Optionally, the cleansing solution includes dimethyl benzylammonium chlorides monohydrate. Alternatively, the soap bar is placed on a rack in the steaming unit. In one alternative, a pan is placed under the rack. In one alternative, the steaming unit is a Rational Clima Plus Combi unit. In another alternative, the steaming is for a period of five minutes at 212° F. In another alternative, the cooling is in a refrigerator unit at 38° F. for at least seven minutes. In another alternative, the method further includes packing the soap bar for reuse.

In another embodiment, a method for recycling soap includes scraping the surface of a soap bar using a bladed implement; soaking the soap bar in a cleansing solution including dimethyl benzylammonium chlorides monohydrate; placing the soap bar on a rack in a Rational Clima Plus Combi unit; placing a pan under the rack; steaming the soap bar using the Rational Clima Plus Combi unit for five minutes at 212° F.; cooling the soap bar in a refrigerator unit at 38° F. for at least seven minutes; and packaging the soap for reuse.

In another embodiment, a method for recycling soap includes scraping the surface of a soap bar; and soaking the soap bar in dimethyl benzylammonium chlorides monohydrate.

DETAILED DESCRIPTION

Figure 1:
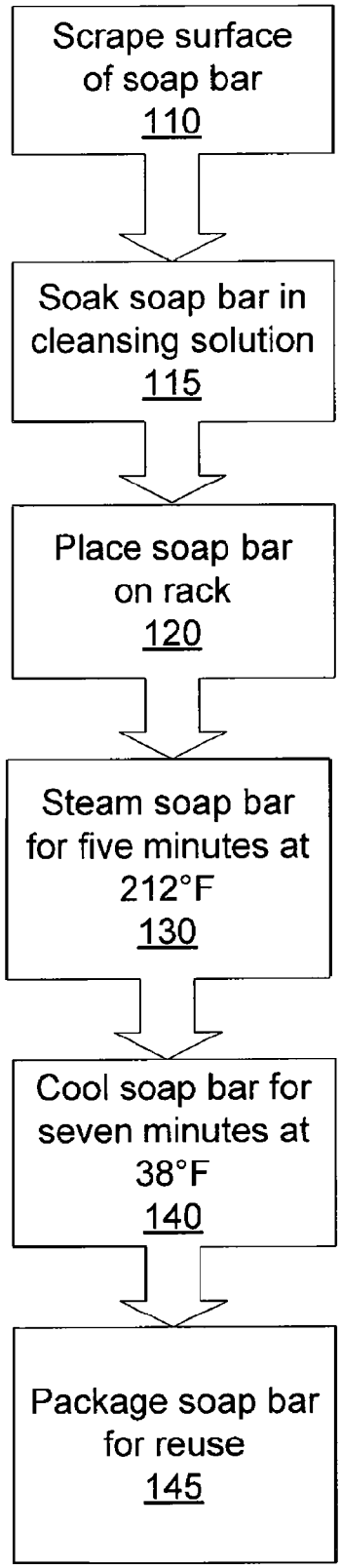
FIG. 1 shows one embodiment of a method of recycling soap.

One embodiment of a soap recycling method is shown in FIG. 1. In step 110, the surface of each bar of soap is scraped in order to clean it. In the context of this application, "soap bar" refers to any solid piece of soap and is not intended to be limited to any particular shape. This scraping process removes hair, paper, or other materials that may be stuck to the surface of the soap. Optionally, a knife or double bladed peeler is used to perform the scraping. In one alternative, this process may be automated. A scraping machine removes a thin layer of soap from all sides of the soap in order to ensure no materials are stuck to the soap. In one alternative, soap shavings from the manual and/or automated process are melted and used to produce a liquid soap or reformed into bar soap after impurities have been removed.

Figure 2:
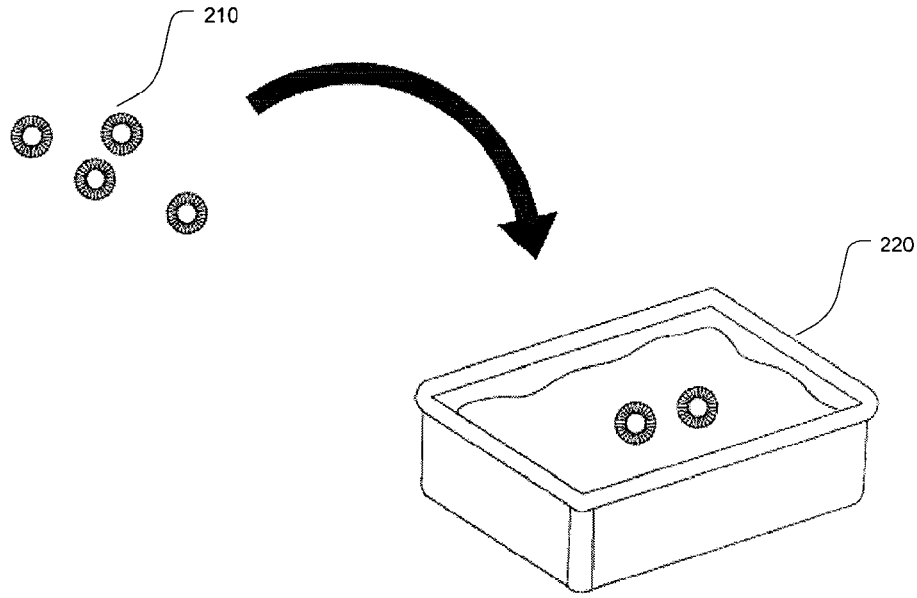
FIG. 2 shows the addition of soap to a cleansing bath according to one embodiment.
Figure 3:
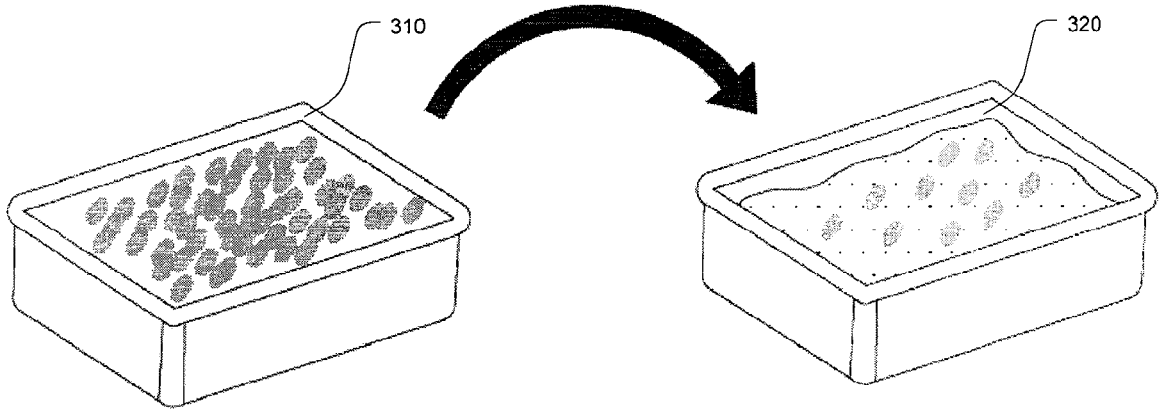
FIG. 3 shows the soaking of soap in a cleansing bath according to one embodiment.

In step 115, the scraped soap bars are soaked in a cleansing solution. In one alternative, Victory Cleansing solution is used (Mfg: Bar Maid; Active Ingredients: n-Alkyl (C14 95%, C12 3%, C16 2%) dimethyl benzylammonium chlorides monohydrate; Inert Ingredients: (50%)). A variety of disinfectants can be used for this step. Disinfectants include, but are not limited to, alcohols, aldehydes, oxidizing agents, phenolics, quaternary ammonium compounds (as in the above Victory Cleansing example), etc. Ultraviolet light is an alternative disinfectant. Certain disinfecting agents may have interactions with the soap and, therefore, are less desirable as a disinfecting agent. For instance, alcohols and oxidizing agents may dissolve the soap more rapidly than quaternary ammonium compounds. Surfactants may be included in the disinfectant mixture in order to improve wetting and lower interfacial tension. In one alternative, a concentrated solid form cleansing solution precursor is added to a water bath to form the cleansing solution. Soap bars 210 are added to bath 220, as shown in FIG. 2. The bars of soap will be soaked for 45 seconds as shown in FIG. 3. In alternatives, the soap may be soaked for a longer or shorter period depending on the disinfectant used and the required time to disinfect. The bars are shown soaking in bath 310 and, after some time, some of the soap may dissolve, as shown in bath 320. Disinfectants that can produce a log 5 reduction in 30 seconds are used for the disinfectant bath.

Figure 4:
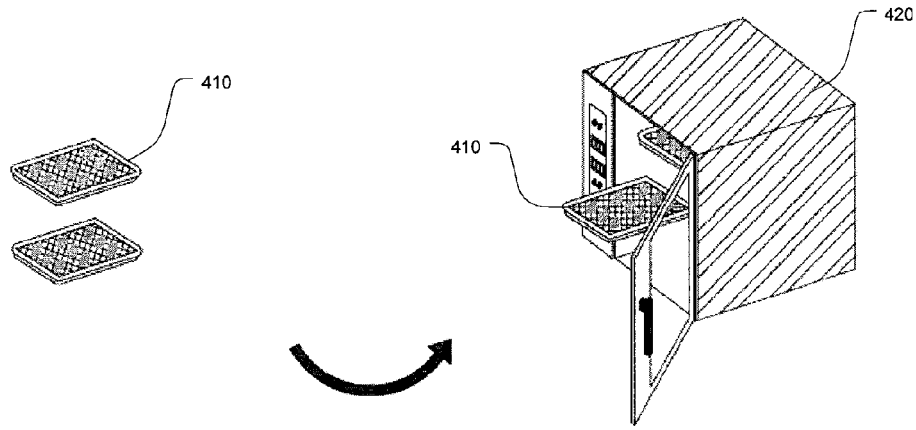
FIG. 4 shows the addition of soap to the steaming unit according to one embodiment.

In step 120, the soap is removed from the bath and placed on a rack as shown in FIG. 4. Racks 410 are then placed in the soap steamer 420. Optionally, a tray is placed under the racks 410 in order to catch soap drippings that may result from the steaming. In one embodiment, soap steamer 420 is a Rational Clima Plus Combi unit; however, any unit that can achieve the requisite temperature can be substituted. When using the Rational Clima Plus Combi unit, ten racks and pans are prepared having five rows of ten bars of soap each. This is based on the typical size of hotel soap.

Figure 5:
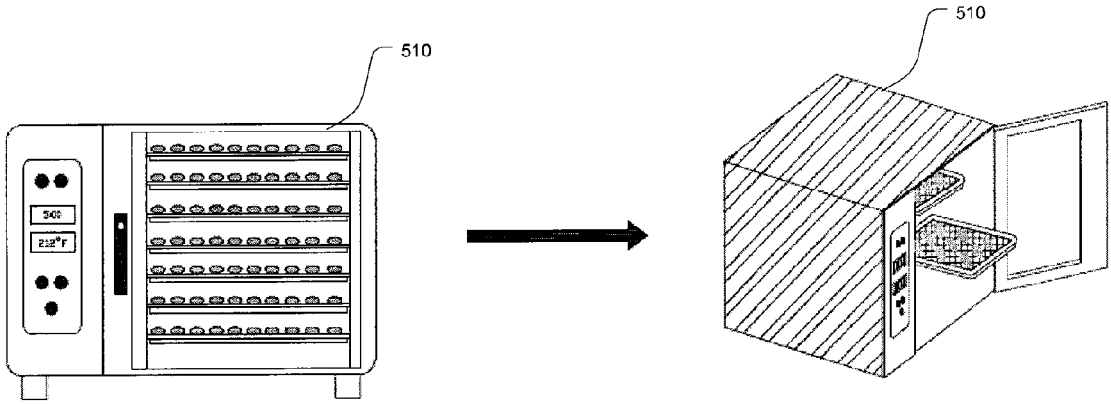
FIG. 5 shows the steaming and removal of soap according to one embodiment.

In step 130, as shown in FIG. 5, the soap is steamed for five minutes at 212° F. in soap steamer 510. Alternatively, the time of steaming and the temperature of steaming are adjusted up or down dependent on the melting point of the soap and the dissolution rate of the soap being steamed. A longer steaming time or higher temperate typically results in more purified soap; however, additional soap may be lost/liquefied in the process. After steaming, the trays are removed from the steamer 510, as shown in FIG. 5. Soap that is liquefied or melted that ends up on the pans may be reclaimed by melting the soap into bars or turning it into liquid soap.

Figure 6:
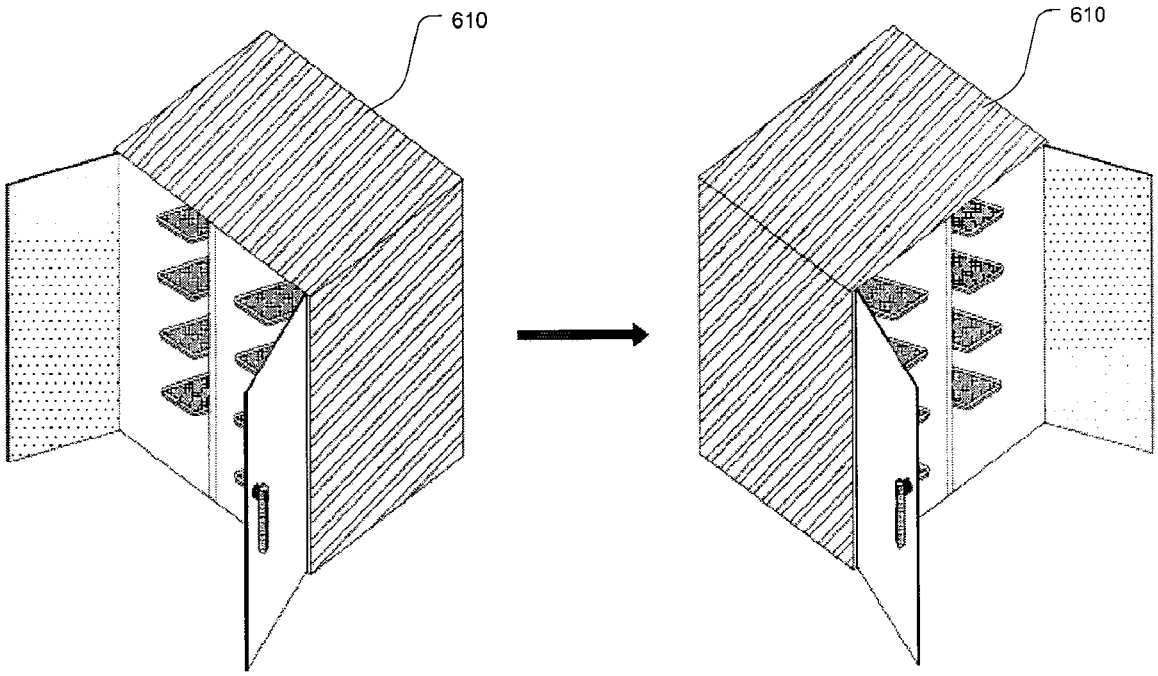
FIG. 6 shows the cooling of soap according to one embodiment.

In step 140, the soap is cooled. As shown in FIG. 6, Refrigerator 610 is used to cool the soap bars. Refrigerator 610 is set to 38° F. The soap bars cool for seven to ten minutes wherein the soap bars harden. The rack and pans are removed from Refrigerator 610.

Figure 7:
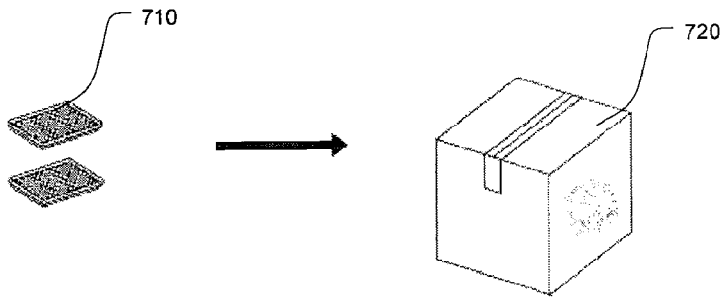
FIG. 7 shows the packaging of soap according to one embodiment.

In step 145, the soap is repackaged for reuse. As shown in FIG. 7, the trays of soap 710 are packaged into boxes 720 for shipment to desired parties.

One embodiment of the system may include a surface cleaning area, operated by humans, or automated; a soaking area, in which bars are soaked; a steaming unit; a cooling unit; and a packaging unit. Note that the transportation of soap between areas and units may be automated, as may the tasks at each stage/unit.

One embodiment of a method of soap collection and recycling includes a number of steps. Soap recycling awareness posters are hung in housekeeping areas. Soap recycling containers or bags are included in housekeeping carts. In addition to bar soap, liquid soap is collected from rooms. Housekeepers collect soap and shampoo and place them in collection containers or bags. In one alternative, housekeepers sort the soap and shampoo into separate bags. Bins or other containers are provided to collect the bags/containers in housekeeping staging areas. The bins are picked up for soap recycling. Collection bins have a secured top, a shipping label is applied, and the bins are shipped to a recycling plant.

For liquid soap, bottles less than ⅓ filled are consolidated into one gallon jugs. Bottles more than ⅓ filled are processed. Empty bottles are recycled. Sufficiently full bottles are topped off and cleaned to remove loose shampoo with water and chlorine. One gallon jugs may be distributed to domestic homeless shelters or other desired users. Bar soap may be cleaned as described above and distributed.

Although the present invention has been described with reference to specific embodiments, this description is not meant to be construed in a limited sense. Various modifications of the disclosed embodiments, as well as alternative embodiments of the present invention, will become apparent to persons skilled in the art upon the reference to the description of the present invention.

We claim:

1. A method for recycling soap, comprising:
(a) scraping the surface of a soap bar, wherein the scraping is performed with a bladed implement;
(b) soaking the soap bar in a cleansing solution;
(c) steaming the soap bar using a steaming unit; and
(d) cooling the soap bar.

2. The method of claim 1 wherein the cleansing solution includes dimethyl benzylammonium chlorides monohydrate.

3. The method of claim 1 wherein the soap bar is placed on a rack in the steaming unit.

4. The method of claim 3 wherein a pan is placed under the rack.

5. The method of claim 1 wherein the steaming unit is a Rational Clima Plus Combi unit.

6. The method of claim 1 wherein the steaming is for a period of five minutes at 212° F.

7. The method of claim 1 wherein the cooling is in a refrigerator unit at 38° F. for at least seven minutes.

8. The method of claim 1, further comprising:
(e) packing the soap bar for reuse.

9. A method for recycling soap, comprising:
(a) scraping the surface of a soap bar using a bladed implement;
(b) soaking the soap bar in a cleansing solution including dimethyl benzylammonium chlorides monohydrate;
(c) placing the soap bar on a rack in a Rational Clima Plus Combi unit;
(d) placing a pan under the rack;
(e) steaming the soap bar using the Rational Clima Plus Combi unit for five minutes at 212° F.;
(f) cooling the soap bar in a refrigerator unit at 38° F. for at least seven minutes; and
(g) packaging the soap for reuse.

10. A method for recycling soap, comprising:
(a) scraping the surface of a soap bar; and
(b) soaking the soap bar in dimethyl benzylammonium chlorides monohydrate.

* * * * *